US005313259A

United States Patent [19]

Smith

[11] Patent Number: 5,313,259

[45] Date of Patent: May 17, 1994

[54] SYSTEM AND METHOD FOR OPERATING A MULTITONE IMAGING APPARATUS

[75] Inventor: Richard E. Smith, Fairport, N.Y.

[73] Assignee: Xerox Corporation, Stamford, Conn.

[21] Appl. No.: 992,684

[22] Filed: Dec. 18, 1992

[51] Int. Cl.[5] ..... G03G 15/01

[52] U.S. Cl. ..... 355/326 R; 118/645; 346/157; 355/219; 355/228

[58] Field of Search ..... 355/326, 219, 327, 221, 355/228, 229; 118/645; 346/157

[56] References Cited

U.S. PATENT DOCUMENTS

| | | | |
|---|---|---|---|
| 4,572,651 | 2/1986 | Komatsu et al. | 355/326 X |
| 4,578,331 | 3/1986 | Ikeda et al. | 346/157 X |
| 4,734,735 | 3/1988 | Haneda | 355/326 |
| 4,789,612 | 12/1988 | Haneda et al. | 355/326 X |
| 4,860,048 | 8/1989 | Itoh et al. | 355/326 X |
| 4,987,455 | 1/1991 | Lubberts | 355/326 X |
| 5,134,444 | 7/1992 | Tabuchi et al. | 355/326 |

FOREIGN PATENT DOCUMENTS

| | | | |
|---|---|---|---|
| 56-27164 | 3/1981 | Japan | 355/326 |

*Primary Examiner*—A. T. Grimley
*Assistant Examiner*—Shuk Y. Lee
*Attorney, Agent, or Firm*—Finnegan, Henderson, Farabow, Garrett & Dunner

[57] ABSTRACT

A multicolor imaging device capable of operating at higher than normal speeds when a full range of colors is not required. The imaging device includes four station groups each having a charge scorotron, a light source for exposing a photoconductive belt to a color signal, and a toner developer. When a color of a particular station is not required, the light source for that station is disabled and the charge scorotron of that station is enabled to allow a higher charging rate for the required colors, thereby allowing the belt to be propelled at a higher speed.

20 Claims, 4 Drawing Sheets

PROCESS SPEED / STATION GROUP FUNCTION CHART

| PRINT OUTPUT | PROCESS SPEED | STATION GROUP COLOR 1 | STATION GROUP COLOR 2 | STATION GROUP COLOR 3 | STATION GROUP BLACK |
|---|---|---|---|---|---|
| BLACK ONLY | X<br>EXAMPLE: 10"/SEC. | CHARGE | CHARGE | CHARGE | CHARGE<br>EXPOSE<br>DEVELOP |
| BLACK + 1 COLOR | X/2<br>EXAMPLE: 5"/SEC. | CHARGE | CHARGE<br>EXPOSE<br>DEVELOP | CHARGE | CHARGE<br>EXPOSE<br>DEVELOP |
| BLACK + 3 COLORS | X/4<br>EXAMPLE: 2.5"/SEC. | CHARGE<br>EXPOSE<br>DEVELOP | CHARGE<br>EXPOSE<br>DEVELOP | CHARGE<br>EXPOSE<br>DEVELOP | CHARGE<br>EXPOSE<br>DEVELOP |

Fig. 4

SYSTEM AND METHOD FOR OPERATING A MULTITONE IMAGING APPARATUS

BACKGROUND OF THE INVENTION

1. Field of the Invention

The present invention relates to system and method for operating a multitone imaging apparatus, and more particularly to a system and method for operating an apparatus having a photoreceptor and multiple units for depositing charge on the photoreceptor.

2. Discussion of the Related Art

A typical image printer may employ a latent development system having a photoconductive surface and a charging unit for depositing charge on the photoconductive surface. After being charged by the charging unit, the photoconductor surface is selectively exposed to a light pattern to selectively discharge the photoconductive surface, thereby producing a pattern of charge corresponding to an image. Subsequently, the photoconductive surface is exposed to charged toner, which adheres to charged portions of the photoconductor surface.

When a printer is compact, the various parts of the printer tend to have a reduced size. Generally, reducing the size of the charging unit results in the charging unit being capable of depositing less charge per unit time. Reduced charge per unit time results in reduced image quality or in reduced printing speed.

ADVANTAGES AND SUMMARY OF THE INVENTION

It is an advantage of the invention to a system and method of operating an image processing apparatus to provide an improved trade-off between printing speed and image quality.

To achieve this and other advantages of the invention, an imaging apparatus comprises a photoreceptor; a plurality of station groups, each station group including charge depositing means for depositing charge on the photoreceptor, exposing means for selectively exposing the photoreceptor to radiation; means for moving the photoreceptor relative to the plurality of stations; and means for selecting a station group and for disabling the exposing means in the selected station group and concurrently enabling the charge depositing means in the selected station group.

According to another aspect of the current invention, in an imaging apparatus having a photoreceptor, a plurality of station groups, each station group including charge depositing means for depositing charge on the photoreceptor, and exposing means for selectively exposing the photoreceptor to radiation, a method of operating the imaging apparatus comprises the steps of moving the photoreceptor relative to the plurality of stations; and selecting a station group and disabling the exposing means in the selected station group and concurrently enabling the charge depositing means in the selected station group.

The accompanying drawings, which are incorporated in and which constitute a part of this specification, illustrate one embodiment of the invention and, together with the description, explain the principles of the invention.

BRIEF DESCRIPTION OF THE DRAWINGS

In the drawings,

FIG. 4 is a chart illustrating operating modes of the preferred embodiment of the invention.

DESCRIPTION OF THE PREFERRED EMBODIMENTS

Figure 1:
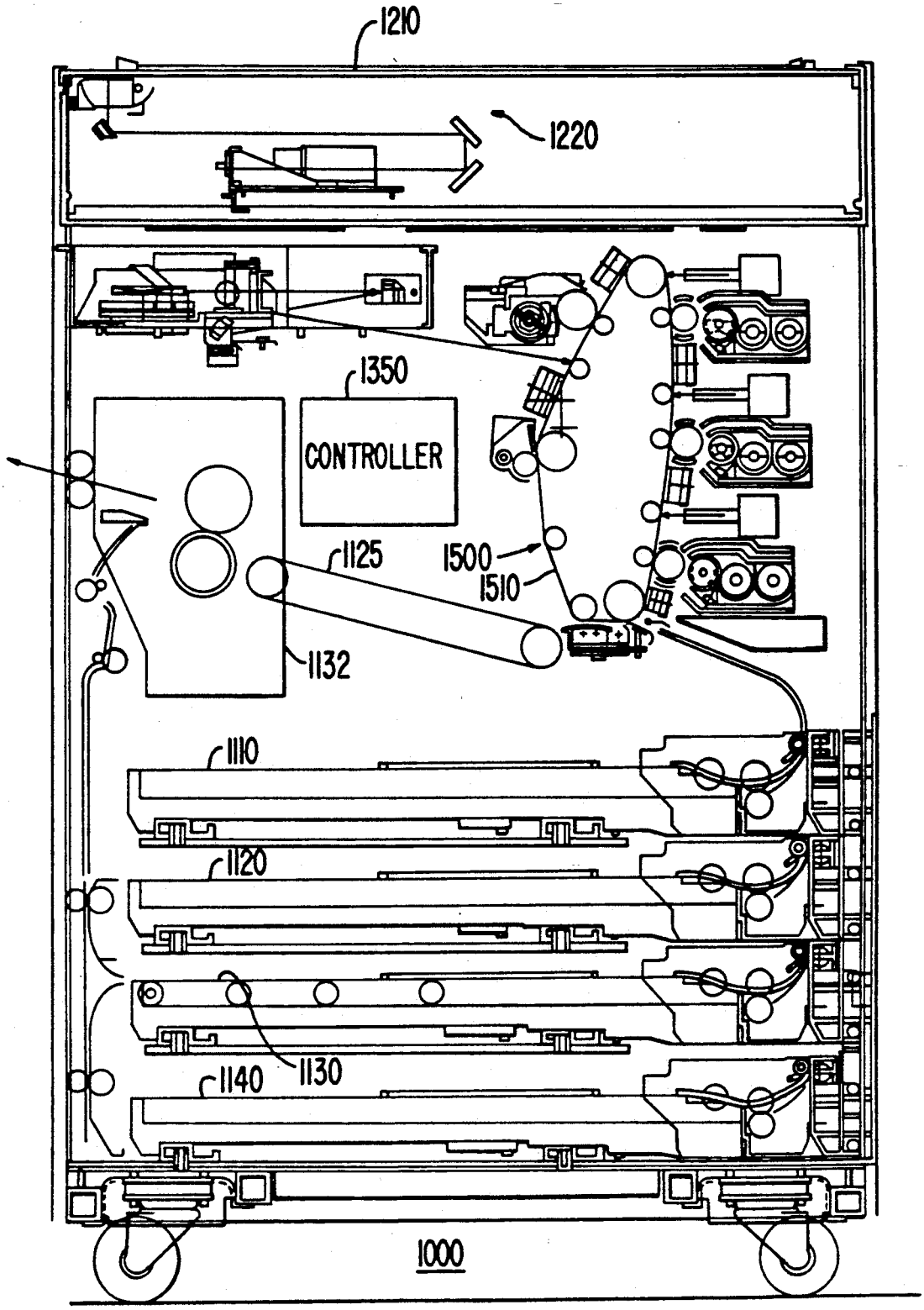
FIG. 1 is largely schematic side elevation showing a preferred embodiment of the present invention.

In FIG. 1, shows a copier 1000 that represents a preferred embodiment of the present invention. Copier 1000 has a height of 940 mm.

In operation of copier 1000, an input scanner 1220 scans an original document on platen a 1210, to produce a latent image on a photoreceptor belt 1510 in photoreceptor assembly 1500, to be described in more detail below. A sheet of paper from one of several paper trays 1110, 1120, 1130, 1140 contacts belt 1510 so that a pattern of toner on belt 1510 is attracted to the paper. A vacuum transport 1125 transports the paper to a fuser 1132, which permanently affixes the toner to the paper with heat and pressure. The paper then advances out of copier 1000, or to a paper tray 1130 allowing the paper to return to belt 1510 for printing an image on an opposite side of the paper.

A controller 1350 controls photoreceptor assembly 1500 as described in more detail below.

Figure 2:
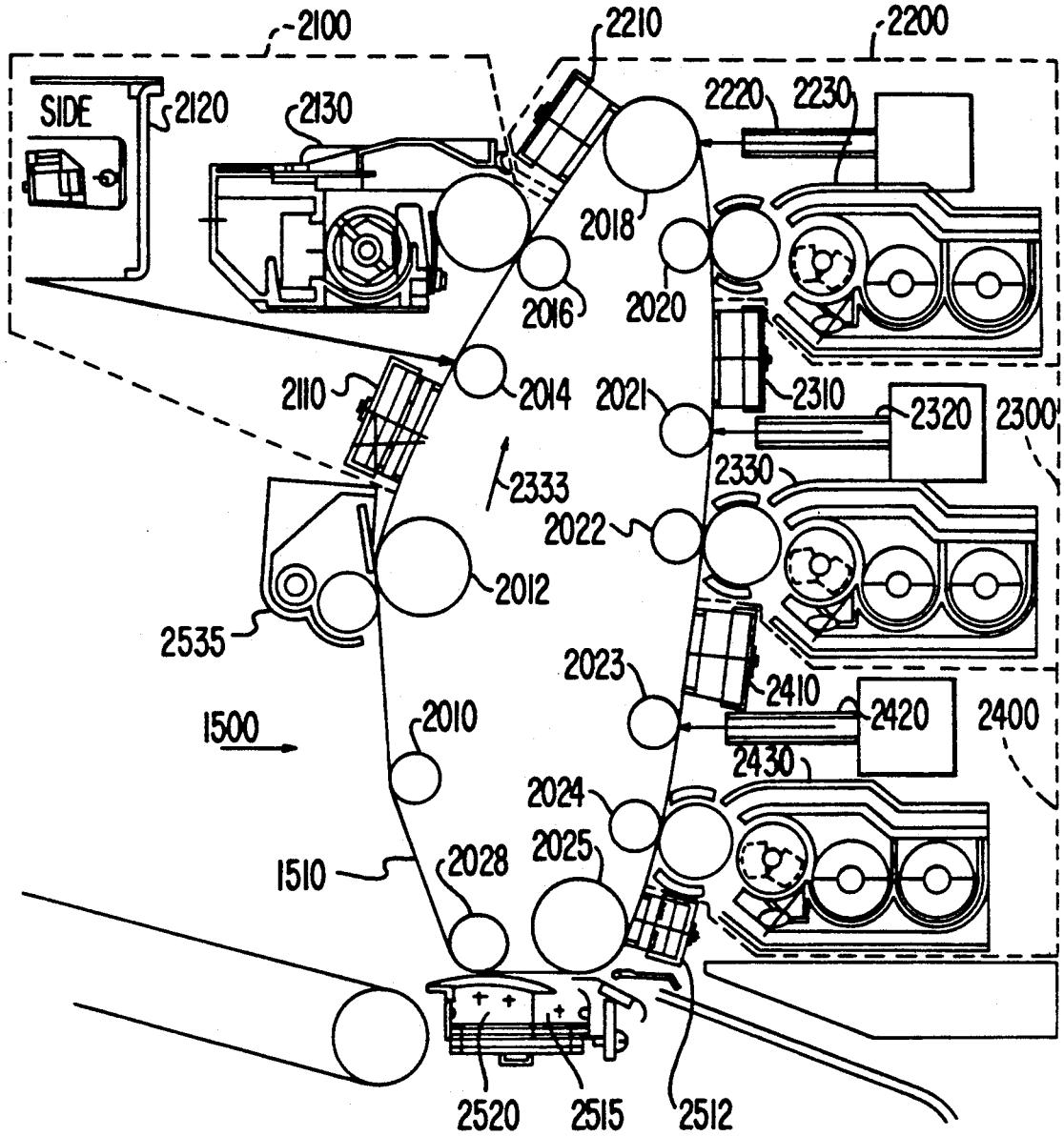
FIG. 2 is an enlarged fragment of components shown in FIG. 1.

FIG. 2 shows photoreceptor subassembly 1500 in more detail. Belt 1510 is entrained around rollers 2010–2028. Roller 2028 is rotated by a motor coupled to the roller by suitable means such as a belt drive (not shown). Roller 2028 advances belt 1510 in the direction of arrow 2333 through various processing stations disposed around the movement path of belt 1510. The preferred copier 1000 includes four groups of stations for printing in four colors, e.g., cyan, magenta, yellow and black. A station group 2100 includes charge scorotron 2110 having a single row of charge pins, a raster output scanning (ROS) laser assembly 2120, and a toner developer 2130. Developer 2130 employees a development system in which toner may transfer from the developer to belt 1510, without developer 2130 contacting belt 1510.

Another station group 2200 includes a scorotron 2210, a LED assembly 2220, and a developer 2230. A third station group 2300 includes a scorotron 2310, a LED assembly 2320, and a developer 2330. A fourth station group 2400 includes a scorotron 2410, a LED assembly 2420, and a developer 2430. LED assemblies 2220, 2320, and 2420 include a bar of LEDs arranged in a longitudinal configuration. Developers 2230, 2330 and 2430 are "scavangeless," meaning that developers 2230, 2330 and 2430 do not remove toner that may already be present on belt 1510.

Thus, copier 1000 includes a first station group; a second station group, located downstream from the first station group; a third station group, located downstream from the second station group; and a fourth station group, located downstream from the third station group.

Developer 2430 may contain black toner, while developers 2130, 2230 and 2330 may contain cyan toner, magenta toner and yellow toner, respectively.

Figure 3:
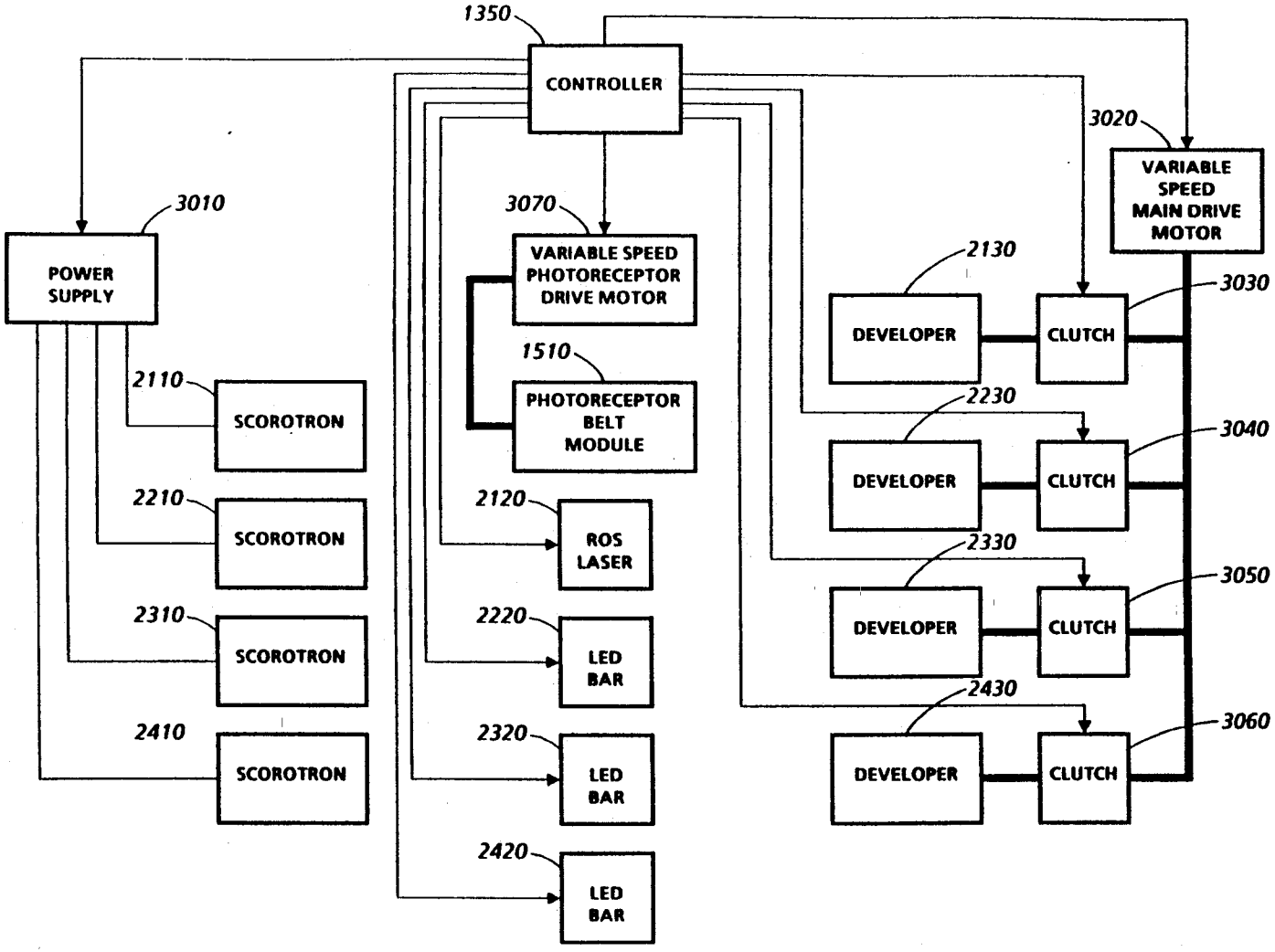
FIG. 3 is a block diagram showing functional elements of the preferred embodiment of the present invention.

FIG. 3 shows control architecture for copier 1000. Controller 1350 includes a general purpose processor, software, and circuitry for interfacing with variable speed photoreceptor drive motor 3070, which is mechanically coupled to belt 1510. Controller 1350 causes belt 1510 to be driven at various speeds, depending on the number of basic colors employed in the copy process, as described in more detail below.

Controller 1350 also controls variable speed main drive motor 3020, which is mechanically coupled to developer 2130 through clutch 3030, to developer 2230 through clutch 3040, to developer 2330 through clutch 3050, and to developer 2430 through clutch 3060. Controller 1350 can selectively disable a developer, such as developer 2330 by disengaging clutch 3050.

The operation of copier 1000 to print four tones will now be described. Scanner 1220 acquires an image that is subsequently decoded into four basic color signals. A first one of the color signals is used to drive ROS laser 2120, a second one of the color signals is used to drive LED assembly 2220, a third color signal is used to drive LED assembly 2320, and a fourth color signal is used to drive LED assembly 2420.

Station group 2100 selectively deposits cyan toner on belt 1510. More specifically, a certain area of the belt 1510 passes by scorotron 2110 to charge belt 1510 to a relatively high, substantially uniform potential. Next, the area of the belt 1510 passes by ROS laser assembly 2120 to selectively expose the area of the belt 1510 to a pattern of light, thereby producing an electrostatic latent image. Next, the area of the belt passes developer 2130 to deposit cyan toner on charged areas of the belt.

The processing by station groups 2200, 2300 and 2400 is similar to the processing of station group 2100, described above, except that station groups 2200, 2300, and 2400 employ LED bar assemblies instead of an ROS laser to selectively expose belt 1510 to light.

After passing developer 2430, the area of belt 1510 is exposed to a pre-transfer scorotron 2512 to reduce the attraction between belt 1510 and the toner that was deposited by developers 2130, 2230, 2330 and 2430. Transfer scorotron 2515 charges a sheet of paper to an appropriate magnitude and polarity so that the paper is tacked to belt 1510 and the toner attracted from belt 1510 to the paper. Subsequently, detack scorotron 2520 charges the paper to an opposite polarity to detack the paper from belt 1510. The paper is then advanced to fuser 1132, which permanently affixes the toner to the copy sheet with heat and pressure.

Blade/brush cleaner 2535 removes toner remaining on belt 1510 after the paper is detacked from belt 1510.

The operation of copier 1000 to print with only one tone, black, will now be described. Controller 1350 fully enables one of the station groups and partially enables the other three station groups. More specifically, controller 1350 enables scorotron 2410 LED assembly 2420, and developer 2430, of station group 2400. Controller 1350 disables developers 2130, 2230 and 2330 by disengaging clutch 3030, 3040 and 3050, respectively; and disables ROS laser 2120, LED assembly 2220 and LED assembly 2320. Controller 1350 enables scorotrons belonging to the station groups of the disabled developers, scorotrons 2110, 2210 and 2310.

Thus, controller 1350 operates to concurrently select the first, second and third station groups, and to disable the developers and exposing elements in the selected groups.

In this single tone print mode, four times the effective charge deposition rate can be achieved, as compared to the four tone printing mode. This higher charge deposition rate allows controller 1510 to cause belt 1510 to be propelled at a higher speed. For example, if the speed of belt 1510 in the four tone mode is 2.5 inches per second, or 10 color prints per minute, in the single tone mode only mode the speed of belt 1510 may be 10 inches per second, allowing 40 single tone prints per minute.

Thus, controller 1350 operates to move belt 1510 at a first speed when controller 1350 selects one of the station groups to disable the developer in the selected station group, and operates to move belt 1510 at a speed lower than the first speed when controller 1510 does not operate to disable a developer.

Alternatively, to print in two tones, station groups 2100 and 2300 may be partially enabled, by enabling scorotrons 2110 and 2310. In this two tone mode, station groups 2200 and 2400 are fully enabled.

FIG. 4 is a chart summarizing the three operating modes of copier 1000. As shown in FIG. 4, when four types of toner, black plus three colors, are employed in the printing process, all four station groups operate to charge belt 1510, expose photoreceptor belt 1510 to light, and develop photoreceptor belt 1510 by depositing toner. When two toners, black plus one color are employed in the print process, all four station groups operate to charge belt 1510, while only two station groups operate to expose and develop belt 1510. When only one tone is employed in the print process, all four station groups operate to charge belt 1510, while only one station group operates to expose and develop photoreceptor belt 1510.

Thus, with the preferred embodiment of the present invention, higher printing speeds may be obtained when only a limited number of tones are employed in the print process.

Additional advantages and modifications will readily occur to those skilled in the art. The invention in its broader aspects is therefore not limited to the specific details, representative apparatus, and illustrative examples shown and described. It is intended that the present invention cover the modifications and variations provided they come within the scope of the appended claims and their equivalents.

We claim:

1. An imaging apparatus comprising:

a photoreceptor;

a plurality of station groups, each station group including charge depositing means for depositing charge on the photoreceptor, exposing means for selectively exposing the photoreceptor to radiation;

means for operating in one of a first mode for concurrently enabling the depositing means of each station group to deposit charge at a common polarity, enabling the exposing means in a one of the station groups, enabling the exposing means in another one of the station groups, and moving the photoreceptor at a first speed relative to the plurality of stations, and a second mode for concurrently enabling the depositing means of each station group to deposit charge at the common polarity, disabling the exposing means in the one of the station groups, enabling the exposing means in the other one of the station groups, and moving the photoreceptor at a speed higher than the first speed relative to the plurality of stations.

2. An imaging apparatus as recited in claim 1, wherein the plurality of station groups includes
a first station group;
a second station group located downstream from the first station group;
a third station group located downstream from the second station group; and
a fourth station group located downstream from the third station group, wherein the second mode concurrently disables the exposing means in each of the first, second and third station groups.

3. An imaging apparatus as recited in claim 1, wherein the plurality of station groups includes
a first station group;
a second station group located downstream from the first station group;
a third station group located downstream from the second station group; and
a fourth station group located downstream from the third station group, wherein the second mode concurrently disables the exposing means in each of the first and third station groups.

4. An imaging apparatus as recited in claim 1, wherein the plurality of station groups includes
a first station group;
a second station group, opposed to the first station group through the photoreceptor.

5. An imaging apparatus as recited in claim 1, wherein each station groups further includes
toner depositing means for depositing toner onto the photoreceptor, each toner depositing means including a respective toner supply.

6. An imaging apparatus as recited in claim 1, wherein the photoreceptor is a flexible belt.

7. A method of operating an imaging apparatus having a photoreceptor, and a plurality of station groups, each station group including charge depositing means for depositing charge on the photoreceptor, and exposing means for selectively exposing the photoreceptor to radiation, the method comprising the step of:
operating in one of
a first mode for concurrently enabling the depositing means of each station group to deposit charge at a common polarity, enabling the exposing means in a one of the station groups, enabling the exposing means in another one of the station groups, and moving the photoreceptor at a first speed relative to the plurality of stations, and
a second mode for concurrently enabling the depositing means of each station group to deposit charge at the common polarity, disabling the exposing means in the one of the station groups, enabling the exposing means in the other one of the station groups, and moving the photoreceptor at a speed higher than the first speed relative to the plurality of stations.

8. A method as recited in claim 7, wherein the plurality of station groups includes a first station group, a second station group located downstream from the first station group, a third station group located downstream from the second station group, and a fourth station group located downstream from the third station group, wherein the disabling step of the second mode includes the substeps of
concurrently disabling the exposing means in each of the first, second and third station groups.

9. A method as recited in claim 7, wherein the plurality of station groups includes a first station group, a second station group located downstream from the first station group, a third station group located downstream from the second station group, and a fourth station group located downstream from the third station group, wherein the disabling step of the second mode includes the substeps of
concurrently disabling the exposing means in each of the first and third station groups.

10. A method as recited in claim 7, wherein each station groups further includes toner depositing means for depositing toner onto the photoreceptor, each toner depositing means including a respective toner supply, and the second mode includes the substep of disabling the toner depositing means in the one of the station groups.

11. An imaging apparatus comprising:
a photoreceptor;
a plurality of station groups, each station group including
charge depositing means for depositing charge on the photoreceptor,
exposing means for selectively exposing the photoreceptor to radiation;
means for operating in one of
a first mode for concurrently enabling the depositing means of the one of the station groups to deposit charge of a first polarity at a first rate, enabling the exposing means in the one of the station groups, enabling the charging means of the other one of the station groups to deposit charge of the first polarity at a second rate, enabling the exposing means in the other one of the station groups, and moving the photoreceptor at a first speed relative to the plurality of stations, and
a second mode for concurrently enabling the depositing means of the one of the station groups to deposit charge of the first polarity at substantially the first rate, disabling the exposing means in the one of the station groups, enabling the charging means of the other one of the station groups to deposit charge of the first polarity at substantially the second rate, enabling the exposing means in the other one of the station groups, and moving the photoreceptor at a speed higher than the first speed relative to the plurality of stations.

12. An imaging apparatus as recited in claim 11, wherein the plurality of station groups includes
a first station group;
a second station group located downstream from the first station group;
a third station group located downstream from the second station group; and
a fourth station group located downstream from the third station group, wherein the second mode concurrently disables the exposing means in each of the first, second and third station groups.

13. An imaging apparatus as recited in claim 11, wherein the plurality of station groups includes
a first station group;
a second station group located downstream from the first station group;
a third station group located downstream from the second station group; and
a fourth station group located downstream from the third station group, wherein the second mode concurrently disables the exposing means in each of the first and third station groups.

14. An imaging apparatus as recited in claim 11, wherein the plurality of station groups includes a first station group;

a second station group opposed to the first station group through the photoreceptor.

15. An imaging apparatus as recited in claim 11, wherein each station groups further includes toner depositing means for depositing toner onto the photoreceptor, each toner depositing means including a respective toner supply.

16. An imaging apparatus as recited in claim 11, wherein the photoreceptor is a flexible belt.

17. A method of operating an imaging apparatus having a photoreceptor, and a plurality of station groups, each station group including charge depositing means for depositing charge on the photoreceptor, and exposing means for selectively exposing the photoreceptor to radiation, the method comprising the step of: operating in one of a first mode for concurrently enabling the depositing means of a one of the station groups to deposit charge of a first polarity at a first rate, enabling the exposing means in the one of the station groups, enabling the charging means of another one of the station groups to deposit charge of the first polarity at a second rate, enabling the exposing means in the other one of the station groups, and moving the photoreceptor at a first speed relative to the plurality of stations, and a second mode for concurrently enabling the depositing means of the one of the station groups to deposit charge of the first polarity at substantially the first rate, disabling the exposing means in the one of the station groups, enabling the charging means of the other one of the station groups to deposit charge of the first polarity at substantially the second rate, enabling the exposing means in the other one of the station groups, and moving the photoreceptor at a speed higher than the first speed relative to the plurality of stations.

18. A method as recited in claim 17, wherein the plurality of station groups includes a first station group, a second station group located downstream from the first station group, a third station group located downstream from the second station group, and a fourth station group located downstream form the third station group, wherein the disabling step of the second mode includes the substeps of concurrently disabling the exposing means in each of the first, second and third station groups.

19. A method as recited in claim 17, wherein the plurality of station groups includes a first station group, a second station group located downstream from the first station group, a third station group located downstream from the second station group, and a fourth station group located downstream from the third station group, wherein the disabling step of the second mode includes the substeps of concurrently disabling the exposing means in each of the first and third station groups.

20. A method as recited in claim 17, wherein each station groups further includes toner depositing means for depositing toner onto the photoreceptor, each toner depositing means including a respective toner supply, and the second mode includes the substep of disabling the toner depositing means in the one of the station groups.

* * * * *